United States Patent [19]

Olund

[11] Patent Number: 4,850,596

[45] Date of Patent: Jul. 25, 1989

[54] ARCHERY TARGET

[76] Inventor: William R. Olund, 1412 Lakewood Blvd., Holland, Mich. 49424

[21] Appl. No.: 136,130

[22] Filed: Dec. 21, 1987

[51] Int. Cl.[4] ..... F41J 3/00

[52] U.S. Cl. ..... 273/408; 273/407; 273/403; 273/DIG. 8; 273/DIG. 10

[58] Field of Search ..... 273/408, 403, 407, DIG. 8, 273/DIG. 10

[56] References Cited

U.S. PATENT DOCUMENTS 3,503,840 3/1970 Parrish ..... 521/54
3,790,437 2/1974 Haley et al. ..... 273/DIG. 8
4,076,246 2/1978 Meyer ..... 273/408
4,683,246 7/1987 Davis et al. ..... 521/54

*Primary Examiner*—Edward M. Coven
*Assistant Examiner*—Valerie Szczepanik
*Attorney, Agent, or Firm*—Price, Heneveld, Cooper, DeWitt & Litton

[57] ABSTRACT

There are disclosed foamable compositions comprising at least one polyisocyanate, at least one polyhydroxy compound and at least one blowing agent having evenly distributed therethrough discrete particles of cellular rubber. The resulting urethane foam-cellular rubber is suitable for use as a target backstop, e.g., archery target backstop.

9 Claims, 1 Drawing Sheet

ARCHERY TARGET

BACKGROUND OF THE INVENTION

This invention relates to targets and more particularly to archery targets.

A variety of materials have been suggested for use in archery targets, including straw, cardboard and foam plastic materials. By and large, the arrows were virtually limited to arrows with steel field tips rather than arrows with broad head tips typically used for hunting. This is because the target damaged the broad head tip or the target was easily damaged by the broad head tip and could not be used for any extensive length of time before replacement and/or repair. Typically, archery targets made of foam plastic material deteriorated rapidly during use so that the target had to be frequently replaced or repaired. Exemplary archery targets that use foam plastic materials are disclosed in Lerman U.S. Pat. No. 3,244,419; Perrine, Sr. U.S. Pat. No. 4,054,288; Stewart U.S. Pat. No. 4,066,261 and Carlin U.S. Pat. No. 4,643,434.

Lerman U.S. Pat. No. 3,244,419 discloses a laminated backboard comprising a corrugated ply to which an outer cardboard ply is connected with a resilient foam polyurethane pad being secured to the outer cardboard ply. The resilient foam polyurethane pad has a transverse width which is slightly greater than the length of the shank of the dart.

Perrine, Sr., U.S. Pat. No. 4,054,288 discloses an archery target comprising a rectangular parallelepiped constructed from a plastic foam material.

Stewart U.S. Pat. No. 4,066,261 discloses an archery target comprising three separate layers constituting a first front layer of expanded polyethylene, a second intermediate layer of relatively lightweight expanded polystyrene and a third rear layer of expanded polyethylene. Both the first and third layers are described as having a substantial thickness with the capacity to close air holes therethrough with the expanded polystyrene layer being substantially thicker and lighter than either of the layers of expanded polyethylene.

Meyer U.S. Pat. No. 4,235,444 discloses an archery target comprising a plurality of membranes which are resilient and tear resistant with the membranes having different coefficients of friction on their front and rear surfaces. The surface of relatively high friction is on the face toward the front or face of the target and the low friction surface is on the backside of the membrane, thereby providing greater frictional resistance during penetration of the arrow as compared with the frictional resistance during withdrawal of the arrow.

Schlotter et al U.S. Pat. No. 4,294,452 discloses an archery target comprising a rear chamber which is filled with a relatively soft, resilient material which is selected from the group consisting of urethane and sponge rubber.

McKenzie et al U.S. Pat. No. 4,477,082 discloses a three-dimensional archery target utilizing a replaceable target segment comprising a lightweight, semi-rigid, tangle-free and nonhealing foam material having a relatively high density in combination with first and second body segments which have a relatively lower density in order to enable the replaceable target segment to withstand the impact of arrows for a longer period.

Carlin U.S. Pat. No. 4,643,434 discloses an archery target comprising a foamed plastic core.

Despite the variety of attempts to provide an archery target for use over any reasonably extended period by archers employing broad head hunting arrows, there remains a need for a target which not only can effectively absorb the energy of the projectile but also permits ready withdrawal of the projectile from the target and which has a reasonable period of use before it must be replaced. In addition, it is preferred that the target will absorb the arrow's energy while retaining the projectile within the body of the target, for example, before the broad head tip and a portion of the shaft passes entirely through the target body.

SUMMARY OF THE INVENTION

The target of the present invention comprises a rigid to semi-rigid polymer foam core with discrete particles of elastomeric foam distributed evenly throughout the foam. The invention is suitable for use with any pointed projectile, such as darts and arrows, and can be used as well with other gaming devices, such as air guns and B—B guns; and is particularly adapted for use with broad head tip arrows. It is a particular feature of the invention that the polymeric foam and elastomer particle core readily absorbs the impact energy of the projectile, such as a broad head tip and is less susceptible to being damaged by entry and withdrawal of broad head tip arrows.

The targets of this invention not only do not damage tips of broad head arrows but also provide a greater longevity of use whereby replacement frequency is reduced. These and other objects advantages and features of the invention will be more fully understood and appreciated by reference to the Description of the Preferred Embodiment and appended drawings.

DESCRIPTON OF THE PREFERRED EMBODIMENT

Figure 1:
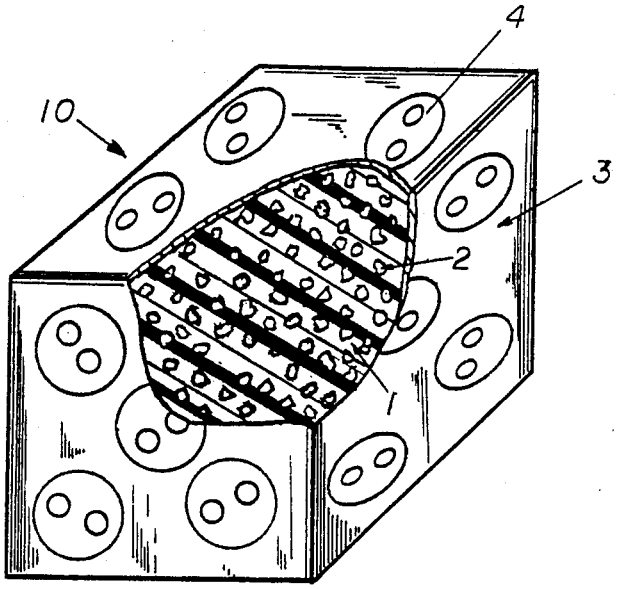
FIG. 1 is a three-dimensional representation of a typical target made in accordance with the present invention.

In the preferred embodiment, target 10 comprises a rigid to semi-rigid foam core 1 having substantially evenly distributed therethrough discrete elastomeric particles 2, the foam and elastomer particle core being enclosed by a cover material 3 with target areas 4 thereon.

The polymer foam core of the invention preferably comprises rigid to semi-rigid urethane foam. It must be rigid or semi-rigid so that it holds its shape as molded. It must have dimensional stability. It must not be floppy or easily misshaped, like a flexible foam would be, when hit by a projectile. The urethane foam core has a density in the range from 1.5 to 12, preferably 2 to 8, and most preferably 3 to 6 pounds/cubic foot (pcf). The foam core is prepared by foaming a homogeneous admixture of urethane foam precursor materials, with the discrete elastomer particles distributed evenly therein.

Any of the commercially available rigid to semi-rigid urethane foam systems can be used in the practice of this invention. Typically, such foam systems comprise linear or branched compounds containing two or more reactive isocyanate groups; monomeric or polymeric compounds containing two or more groups which are reactive with isocyanate groups and foaming agents.

Representative isocyanate-containing compounds include both monomeric and polymeric isocyanatefunctional compositions, with monomeric polyisocyanates being currently preferred. The most preferred polyisocyanate at this time is 4,4'-methylene-bis (phenyl isocyanate). Other suitable polyisocyanates include, without being limited to these compounds, toluene diisocyanate, 4,4'-diphenyl diisocyanate, 4,4'-diphenyl methane diisocyanate, dianisidine diisocyanate, 1,5-naphthalene diisocyanate, hexamethylene diisocyanate, isophorone diisocyanate, 4,4',4''-triphenyl methane triisocyanate and the adduct of one mole of trimethylol propane with three moles of 4,4'-methylenebis(cyclohexyl isocyanate).

Hydroxy-containing compounds are currently preferred as the reactant containing two or more groups which are reactive with isocyanate groups. Representative of hydroxy-containing compounds are polyester polyols and polyether polyols such as polyethylene glycols, polytetramethylene glycols and the like. Other suitable polyols include ethylene glycol, diethylene glycol, 1,4-butane diol, glycerol, trimethylol propane and erythritol. Currently preferred hydroxy-containing compounds are polyether, polyester and poly(ether-ester) diols and triols, with mixtures of such diols and triols being currently preferred.

Any conventional urethane foaming agent can be used. Typical foaming agents include those which either react with isocyanate groups to form carbon dioxide or which can liberate or otherwise form a gas under reaction conditions. Among suitable foaming agents are water, carbon dioxide, liquids with low boiling points which evaporate as a result of the exothermic polyaddition reaction, such as methylene chloride, trichlorofluoromethane, dichlorodifluoromethane, dichloromonofluoromethane, dichlorotetrafluoroethane and 1,2-trichloro-1,2,2-trifluoroethane, alkaline and alkaline carbonates and bicarbonates such as sodium and potassium carbonates or bicarbonates, azo, hydrazide and amide compounds and mixtures thereof. The azo compounds include diazo amino benzene, 1,3-diphenyl triazine, 2,2'-azo-isobutyrolnitrile, benzene sulfonyl hydrazide, p-p'-oxy-bis-benzene sulfonyl hydrazide, p-tert-butylbenzoazide, N,N'-di-methyl-N,N'-dinitrosoterephthalamide and trihydrazide triazine. Currently, fluorine-containing foaming agents, such as mono-fluoro trichloromethane and 1,2,2-trichloro-1,2,2-trifluoromethane.

Catalysts may be used to accelerate the formation of the urethane foam, such as tertiary amines and organometallic salts, such as N-methylmorpholene, triethylenediamine, N,N-dimethylethanolamine, dibutyltinlaurate and stanousoctoate; surfactants such as organic polysiloxanes, oxyethylated alkyl phenols and oxyethylated fatty alcohols; flame retardants, such as phosphorous-containing and halogen containing compounds and particulate fillers, such as carbon black. Materials such as glass beads and glass fibers are not suitable additives since their presence would damage the projectile point or interfere with its withdrawal.

Rigid urethane foams include isocyanurate as well as urethane products. Most rigid foam is made from polymeric methylene diphenyl isocyanate of a functionality of greater than 2 in order to facilitate cross linking. High functionality, low molecular weight polyols also contribute rigidity by cross linking and by contributing to short chain length. Isocyanate for isocyanurate formulations is typically a polymeric methylene diphenyl isocyanate of a functionality of 2.7. The functionality of the polyol is usually 2 to 4. While the proportion of isocyanate to polyol is roughly 1 to 1 for urethane, the ratio is higher than 2 to 1 for isocyanurates. The extra isocyanate is consumed in the trimerization reaction. The polyol reacts with some isocyanate to form urethane linkages needed to impart resiliency to the foam.

A currently preferred commercially available urethane foam system is FOAM SEAL, a product of Foam Seal, Inc., believed to be a mixture of polyether diols and triols, 4,4'-methylene-bis (phenyl isocyanate) and a fluorocarbon blowing agent.

The discrete, elastomeric particles to be distributed throughout the foam core have elastic and stretchable characteristics. Suitable elastomeric materials include cured natural and synthetic rubber materials which do not contain reinforcing cords, such as steel, fiberglass, nylon, cotton or the like. Preferably, the elastomeric materials have at least a limited porosity in order to absorb the liquid urethane foam precursor materials in a limited amount. The elastomeric materials are solid, rather coarse materials which are preferably comminuted to a particle size on the order of $\frac{1}{8}$ inch to $\frac{5}{8}$ inch, most preferably $\frac{1}{4}$ inch in diameter. Particles which are too large or too small present problems with obtaining proper mix ratios and can provide a resultant foam-elastomer core with a final density which is too hard, does not have the desired resiliency and may have insufficient foam. Particuarly preferred elastomeric materials are flexible cellular rubbers including expanded rubber, latex foam rubber and sponge rubbers selected from the group consisting of natural rubbers and synthetic rubbers, including butadiene-styrene, neoprene, butyl, nitrile, polysulfide, chlorosulfonated polyethylene, cis-1,4-polybutadiene, synthetic cis-1,4-polyisoprene, adduct and urethane rubber. Although not as preferred, vulcanized, nonreinforced rubbers, including reclaimed rubbers, other than sponge rubbers, can be employed in whole or in part as the elastomeric material. Currently, natural and synthetic sponge rubbers are preferred. The elastomeric particle will typically comprise from 25 to 75, preferably 30 to 70 and most preferably 45 to 55, volume percent of the target core.

In preparing the foam cores of the invention, the polyisocyanate and polyol urethane precursor materials are reacted in amounts such that the OH:NCO ratio is in the range of 1:95–1.3, preferably 1:1.05–1.3. Flexible foams result at ratios of 1:0.7–0.95, semi-rigid foams typically use ratios of 1:0.95–1.05 and rigid urethane foams use OH:NCO ratios of 1:1.05–1.3.

Preferably, the target cores are prepared utilizing the one-shot process, wherein all the materials are intimately and uniformly mixed, the resulting mixture is introduced into an appropriate form or mold and allowed to expand, preferably in closed molds. Mixing is preferably done at temperatures in the range from 15° to 60° C., most preferably in the range from 20° to 35° C. shape is not critical, since the foams can be made to any desired size and configuration. A 16"×16" 16" cube is well suited for use with 50 to 75 pounds of pull bows. The invention is illustrated by the following examples. It will be understood that the invention is not to be limited to specific details enumerated. Parts are parts by weight unless otherwise expressed.

EXAMPLE 1

A sufficient amount of $\frac{1}{4}$ inch pieces of a sponge rubber was homogeneously dispersed in a mixture of polyether polyols, 4,4'-methylene-bis(phenyl isocyanate), triisopropylamine and monofluorotrichloromethane to provide a mixture comprising about 50% by volume of rubber. The mixture was poured into a 16"×16"×16" mold, the mold was closed and the mixture allowed to expand. The resulting foam core has a foam density of 4.1 pounds/cubic foot.

EXAMPLE 2

The foam core prepared in Example 1 was used to prepare a backstop by covering the core with corrugated paper board on which was imprinted target areas. Broad head tip archery arrows were shot into a $1\frac{1}{4}$ inch target area from 10 yards, using a 66 pound bow. A total of 27 shots were made into the same target area before the tip of an arrow began to penetrate the opposite side of the backstop. The arrows were easily retrieved from the backstop following each shot. Deterioration of the target area from entry and withdrawal of the broad head tip arrows was minimal, even after the last shot.

In a similar manner, a broad head tip arrow shot into the backstop from 10 yards using a 90 pound bow penetrated only $9\frac{1}{4}$ inches into the backstop.

The examples demonstrate that the combination of a polymer foam and solid particles of cellular rubbers provides a backstop or target which can absorb projectile impact energy, retain the projectile with the backstop body and is resistant to deterioration from entry and withdrawal of the projectile.

Of course, it is understood that the above is merely a preferred embodiment and that various changes and alterations can be made without departing from the spirit and broader aspects of the invention.

The embodiments of the invention in which an exclusive property or privilege is claimed are defined as follows:

1. A target consisting essentially of:

target markings backed by a rigid to semi-rigid polymer foam core, said polymer foam having a foam density in the range from about 1.5 to 12 pounds/-cubic foot and having discrete elastomeric particles distributed uniformly throughout said foam and comprising from 25 to 75 volume percent of the volume of said polymer foam core.

2. A target in accordance with claim 1 wherein said discrete elastomeric particles are from about $\frac{1}{8}$ to about $\frac{5}{8}$ inch in diameter.

3. A target in accordance with claim 2 wherein said elastomeric material comprises a sponge rubber.

4. A target in accordance with claim 3 wherein said sponge rubber is selected from the group consisting of natural, butadiene-styrene, neoprene, butyl, nitrile, polysulfide, chlorosulfonated polyethylene, cis-1,4-polybutadiene, synthetic cis-1,4-polyisoprene, adduct and urethane sponge rubber.

5. A target in accordance with claim 4 wherein said elastomeric particles are approximately $\frac{1}{4}$ inch in diameter.

6. A target in accordance with claim 1 wherein said polymer foam core comprises one of a urethane or isocyanurate foam.

7. A target in accordance with claim 6 wherein said discrete elastomeric particles are from about $\frac{1}{8}$ to about $\frac{5}{8}$ inch in diameter.

8. A target in accordance with claim 7 wherein said elastomeric material comprises a sponge rubber.

9. A target in accordance with claim 6 wherein said elastomeric particles are approximately $\frac{1}{4}$ inch in diameter.

* * * * *